US010707602B2

(12) United States Patent
Leigh et al.

(10) Patent No.: US 10,707,602 B2
(45) Date of Patent: Jul. 7, 2020

(54) MODULE BOARD SOCKET CONNECTOR

(71) Applicant: HEWLETT PACKARD ENTERPRISE DEVELOPMENT LP, Houston, TX (US)

(72) Inventors: Kevin B. Leigh, Houston, TX (US); Sunil Ganta, Houston, TX (US); John Norton, Houston, TX (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/773,862

(22) PCT Filed: Dec. 22, 2015

(86) PCT No.: PCT/US2015/067421
§ 371 (c)(1),
(2) Date: May 4, 2018

(87) PCT Pub. No.: WO2017/111951
PCT Pub. Date: Jun. 29, 2017

(65) Prior Publication Data

US 2019/0157783 A1 May 23, 2019

(51) Int. Cl.

| | |
|---|---|
| ***H01R 12/70*** | (2011.01) |
| ***H01R 13/64*** | (2006.01) |
| ***H01R 33/76*** | (2006.01) |
| ***H01R 12/71*** | (2011.01) |
| *H01R 13/621* | (2006.01) |
| *H01R 24/00* | (2011.01) |

(52) U.S. Cl.
CPC ..... *H01R 12/7047* (2013.01); *H01R 12/7005* (2013.01); *H01R 12/7076* (2013.01); *H01R 12/714* (2013.01); *H01R 13/64* (2013.01); *H01R 33/76* (2013.01); *H01R 12/716* (2013.01); *H01R 13/6215* (2013.01); *H01R 24/005* (2013.01)

(58) Field of Classification Search
CPC ..... H01R 12/7005; H01R 13/6315
USPC ..... 439/378, 246, 377, 379, 374
See application file for complete search history.

(56) References Cited

U.S. PATENT DOCUMENTS 4,284,311 A * 8/1981 Forster ..... B61G 5/10 439/34
5,032,088 A * 7/1991 Kuramitsu ..... H05K 7/1084 439/378

(Continued)

FOREIGN PATENT DOCUMENTS

JP 2008527325 A 7/2008

OTHER PUBLICATIONS

International Search Report and Written Opinion, International Application No. PCT/US2015/067421, dated Sep. 20, 2016, pp. 1-9, KIPO.

*Primary Examiner* — Tulsidas C Patel
*Assistant Examiner* — Marcus E Harcum
(74) *Attorney, Agent, or Firm* — Brooks, Cameron & Huebsch, PLLC

(57) ABSTRACT

In one example, a system for a socket connector includes a first alignment feature with a first height to engage with a module board, wherein the first alignment feature horizontally aligns the module board with a socket, and a second alignment feature with a second height to engage with the module board, wherein the second alignment feature vertically aligns the module board with the socket.

12 Claims, 5 Drawing Sheets

(56) References Cited

U.S. PATENT DOCUMENTS

| | | | | |
|---|---|---|---|---|
| 5,076,794 | A * | 12/1991 | Ganthier | H05K 7/1084 439/246 |
| 5,208,529 | A * | 5/1993 | Tsurishima | G01R 1/0433 324/72.5 |
| 5,410,258 | A * | 4/1995 | Bowers | G01R 1/0416 324/756.02 |
| 5,888,101 | A * | 3/1999 | Dent | H01R 13/631 439/378 |
| 6,061,235 | A * | 5/2000 | Cromwell | H01L 23/3675 165/80.3 |
| 6,217,341 | B1 | 4/2001 | Glick et al. | |
| 6,354,844 | B1 | 3/2002 | Coico et al. | |
| 6,454,587 | B1 * | 9/2002 | Malone | H05K 7/1061 439/331 |
| 6,863,541 | B2 * | 3/2005 | Kagami | H01R 13/2435 439/71 |
| 7,824,112 | B2 | 11/2010 | Epitaux et al. | |
| 8,195,017 | B2 | 6/2012 | Kaneshiro et al. | |
| 8,292,634 | B2 | 10/2012 | Takahashi | |
| 8,414,309 | B2 | 4/2013 | Meadowcroft et al. | |
| 9,052,484 | B2 | 6/2015 | McColloch et al. | |
| 9,106,027 | B2 | 8/2015 | Chan et al. | |
| 2003/0064619 | A1 | 4/2003 | Renfro et al. | |
| 2006/0105608 | A1 | 5/2006 | Ma | |
| 2010/0093199 | A1 | 4/2010 | Zhang | |
| 2011/0244711 | A1 * | 10/2011 | Takahashi | H01R 12/716 439/378 |
| 2015/0079815 | A1 | 3/2015 | Leigh et al. | |
| 2015/0340806 | A1 * | 11/2015 | Ilkhanov | H01R 13/6215 439/278 |
| 2015/0362686 | A1 | 12/2015 | Wang et al. | |

* cited by examiner

MODULE BOARD SOCKET CONNECTOR

BACKGROUND

Computing systems can include a system board with a number of socket connectors to couple module boards to the system board. The module boards can be hot-pluggable transceiver modules. The hot-pluggable transceiver modules, such as 1-lane Small Form Factor Pluggable (SFP), 4-lane Quad Small Form Factor Pluggable (QSFP), and 12-Lane CXP, can be used for network data communications. The transceiver modules can be hot-pluggable to the system board, such as a printed circuit board of a switch module. A system board can be behind a faceplate where connectors for coupling communication cables (e.g., fiber optic cables) to the transceiver modules are arranged.

DETAILED DESCRIPTION

A number of examples for a socket connector are described herein. In one example, a system for a socket connector includes a first alignment feature with a first height to engage with a module board, wherein the first alignment feature horizontally aligns the module board with a socket, and a second alignment feature with a second height to engage with the module board, wherein the second alignment feature vertically aligns the module board with the socket.

In some examples, the socket connector described herein can be utilized for a plurality of different module board types. For example, the socket connector described herein can be utilized to couple hot-pluggable module boards and embedded module boards without modification of the socket connector. In some examples, the first alignment feature can be a different size than the second alignment feature. For example, the first alignment feature can have a greater height compared to the second alignment feature. In some examples, the second alignment feature can be short enough to allow a hot-pluggable module board to pass over the second alignment feature in a blind mate coupling of the hot-pluggable module board to a system board.

In some examples, the socket connector described herein can include a number of electrical connectors that can couple a module board to a system board. In some examples, the socket connector described herein can utilized a number of recessed connection apertures to receive a number of mounting screws and/or a number of mounting screw heads. In some examples, the number of recessed connection apertures can be physically separated from a portion of the socket connector that includes the electrical connections. In some examples, the socket can include a first number of electrical connections on a first side of the socket to couple to the module board and a second number of electrical connections on a second side of the socket to couple to the system board.

The socket connector described herein can provide an electrical coupling between a system board and a number of different module board types. Utilizing the socket connector can provide electrical coupling of different lane-count optical transceiver modules. The socket connector can be utilized to allow interoperability of a number of different module boards such as optical transceivers.

Figure 1:
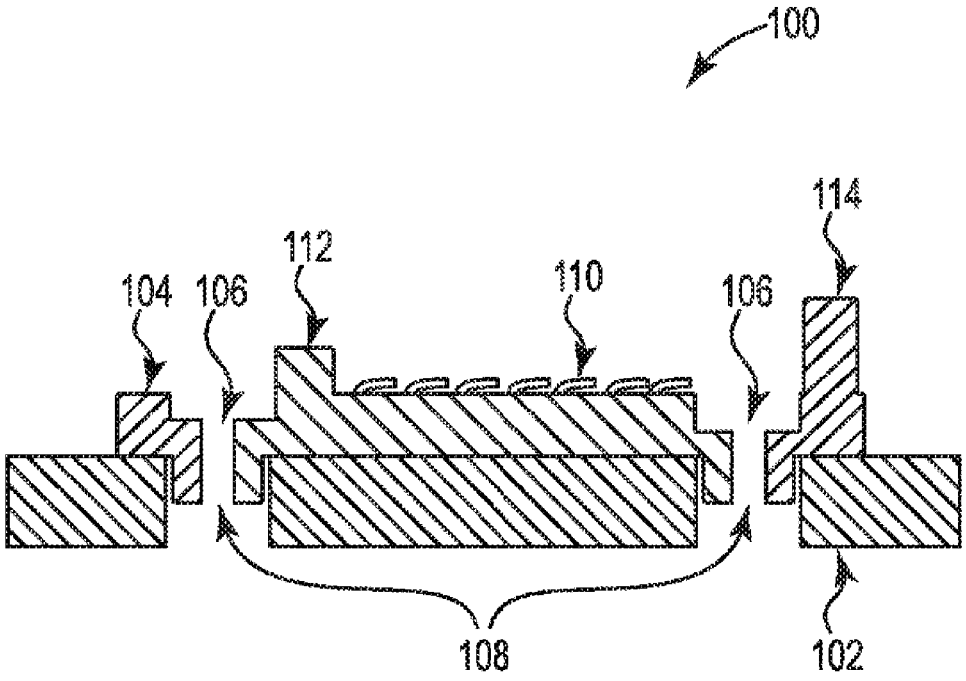
FIG. 1 illustrates a diagram of an example of a system for a socket connector consistent with the present disclosure.

FIG. 1 illustrates a diagram of an example of a system 100 for a socket connector consistent with the present disclosure. The system 100 can include a socket connector 104 (e.g., socket) that can be coupled to a system board 102 (e.g., motherboard, etc.) of a computing device. The socket connector 104 can be utilized to electrically couple a module board to the system board 102. In some examples, the socket connector 104 can include a number of electrical connections 110. In some examples, the number of electrical connections 110 can include spring loaded electrical connections that can be depressed by corresponding electrical connections of a module board.

In some examples, the socket connector 104 can include a horizontal alignment feature 114. The horizontal alignment feature 114 can be utilized to receive a number of alignment notches of a hot-pluggable module board. In some examples, the horizontal alignment feature 114 can be utilized as a vertical alignment features when installing an embedded module board. In some examples, the horizontal alignment feature 114 can have a relatively larger size compared to other alignment features such as a vertical alignment feature 112. In some examples, the relatively larger size of the horizontal alignment feature 114 can include a greater height compared to the other alignment features. In some examples, the relatively larger size of the horizontal alignment feature 112 can include a greater diameter or width compared to the other alignment features.

In some examples, the socket connector 104 can include a vertical alignment feature 112. In some examples, the vertical alignment feature 112 can have a relatively smaller size compared to the other alignment features such as the horizontal alignment feature 114. In some examples, the relatively smaller size can include a relatively shorter height compared to the horizontal alignment feature 114. In some examples, the relatively smaller size of the vertical alignment feature 112 can allow a hot-pluggable module horizontally to pass over the vertical alignment feature 112. When the hot-pluggable module horizontally passes over the vertical alignment feature 112, the hot-pluggable module can be coupled to the horizontal alignment feature 114 via a number of notches of the hot-pluggable module when the hot-pluggable module is vertically lowered on the socket connector 104.

In some examples, the vertical alignment feature 112 can allow a number of screw heads to horizontally pass over the vertical alignment feature 112. In some examples, the vertical alignment feature 112 can be utilized to vertically align a module board (e.g., hot-pluggable module board, embedded module board, etc.) when the module board is vertically lowered on the socket connector 104 to couple the module board to the socket connector 104.

In some examples, the socket connector 104 can include a number of recessed connection apertures. The number of recessed connection apertures can include an aperture portion 108 to receive a number of mounting screws that are utilized to couple a module board to the socket connector 104 and/or to the system board 102. In some examples, the number of recessed connection apertures can include a recessed portion 106. As described further herein, the recessed portion 106 of the number of recessed connection apertures can be utilized to receive a head of a mounting screw utilized to couple a hot-pluggable module to a module carrier (e.g., module bracket, module board carrier, etc.) for installing a hot-pluggable module.

The system 100 can be utilized to couple a number of different types of module boards to a system board 102 via the socket connector 104. For example, the socket connector 104 can be utilized to receive hot-pluggable module boards and embedded module boards. Utilizing the same socket connector 104 for a number of different types of module boards can provide versatility and upgradability for a computing device utilizing the system board 102.

Figure 2:
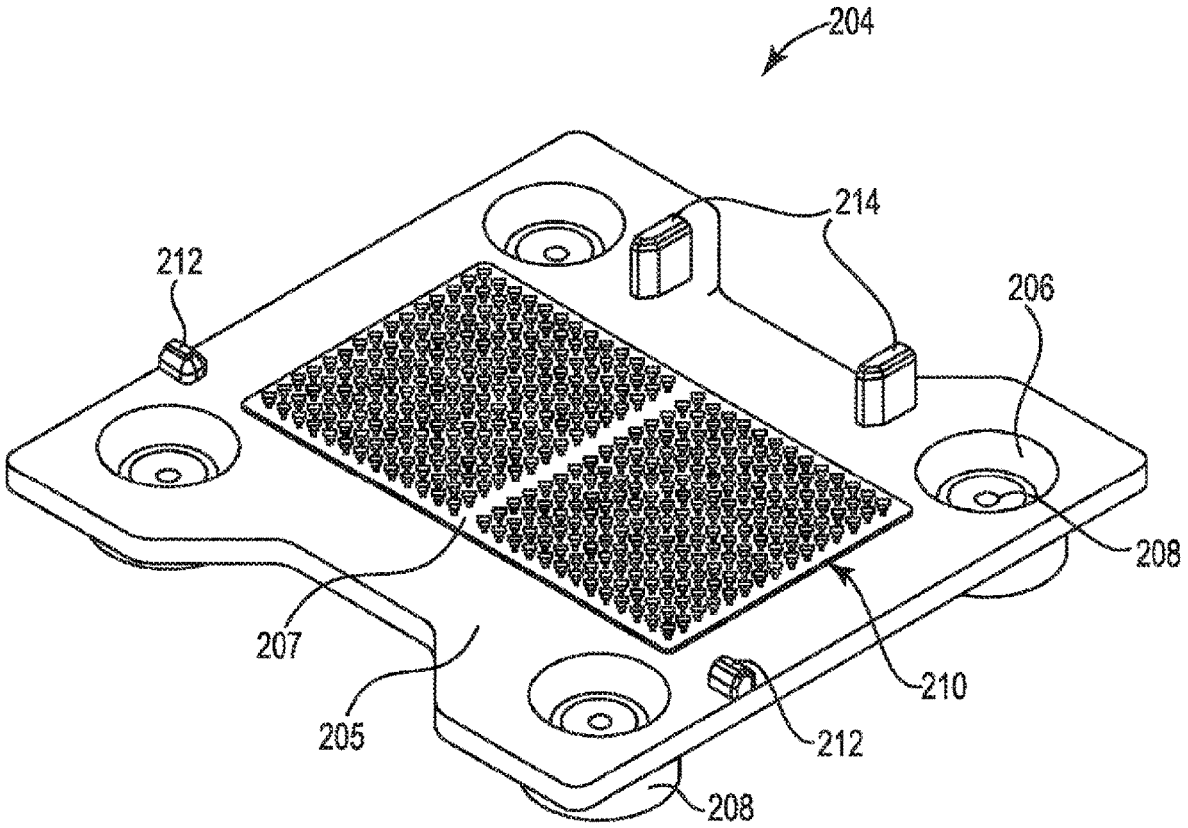
FIG. 2 illustrates a diagram of an example of a socket connector consistent with the present disclosure.

FIG. 2 illustrates a diagram of an example of a socket connector 204 consistent with the present disclosure. The socket connector 204 (e.g., socket) can be an example of socket connector 104 as referenced in FIG. 1. For example, the socket connector 204 can be utilized to couple a number of different types of module boards to a system board. As described herein, the number of different types of module boards can include, but are not limited to hot-pluggable module boards and embedded module boards.

In some examples, the socket connector 204 can include a number of electrical connections 210. The number of electrical connections 210 can be coupled to a module board when the module board is connected to the socket connector 204. The number of electrical connections 210 can be utilized to couple the module board to the system board. In some examples, the electrical connections 210 can be spring loaded electrical connections that can be depressed when the module board is coupled to the socket connector 204. In some examples, the electrical connections 210 can be located on a surface plane 207 higher than the base surface plane 205 of the socket connector 204. The higher surface plane in combination with the depth of the recessed portion 206 of the number of recessed connection apertures may provide mechanical clearance of the screw heads for hot-pluggable module board and may provide better electrical contacts coupling between the module board and the socket connector 204.

In some examples, the socket connector 204 can include a number of alignment features (e.g., horizontal alignment features 214, vertical alignment features 212, etc.). The number of alignment features can be utilized to align connections of a module board on the electrical connections 210. In some examples, the number of horizontal alignment features 214 can be utilized to receive notches of a module board for horizontally aligning the module board with the socket connector 204. For example, the module board can include a notch for each of the number of horizontal alignment features 214. Each notch can be received by a corresponding horizontal alignment feature 214 when the module board is inserted horizontally with the socket connector 204.

In some examples, the number of horizontal alignment features 214 can be relatively larger compared to a number of vertical alignment features 212. For example, the number of horizontal alignment features 214 can have a greater height than the number of vertical alignment features 212. In some examples, the greater height of the number of horizontal alignment features 214 can prevent the module board from passing horizontally over the socket connector 204 when the module board is horizontally coupled to the socket connector 204. For example, a hot-pluggable module board can be inserted horizontally over the socket connector 204 and aligned by the number of horizontal alignment features 214 prior to the hot-pluggable module board being vertically lowered on to the socket connector 204. In some examples, the horizontal alignment features 214 can have a greater diameter or width compared to the number of vertical alignment features 212.

In some examples, the number of vertical alignment features 212 can be relatively smaller compared to the number of horizontal alignment features 214. For example, the number of vertical alignment features 212 can be relatively shorter than the horizontal alignment features 214. In some examples, the number of vertical alignment features 212 can be short enough to allow a module board to pass horizontally over the vertical alignment features. For example, a hot-pluggable module board that utilizes a module carrier can be horizontally inserted into a module cage coupled to a system board. In this example, the module board and module carrier can pass between the number of vertical alignment features 214 and a cage to couple to the horizontal alignment features 212 before being lowered to the socket connector 204. In this example, the vertical alignment features 214 can align the module board when the module board is vertically lowered on to the socket connector 204.

In some examples, the socket connector 204 can include a number of recessed connection apertures. The number of recessed connection apertures can include an aperture portion 208 that can be utilized to receive a number of mounting screws. In some examples, the mounting screws can physically couple the module board to the socket connector 204. In some examples, the mounting screws can pass through the aperture portion 208 and be received by mounting screw receiving threads below the aperture portion 208. In these examples, the number of recessed connection apertures can be utilized to mount an embedded module board to the socket connector 204.

In some examples, the number of recessed connection apertures can include a recessed portion 206. In some examples, the recessed portion 206 can receive a head portion of a mounting screw. In some examples, a hot-pluggable module board can be coupled to a module carrier by a number of mounting screws. In these examples, a head portion of the mounting screws can be below the hot-pluggable module board. In these examples, the recessed portion 206 can receive the head portion of the mounting screws when the hot-pluggable module board is coupled to the socket connector 204. In some examples, the recessed portion 206 can allow the hot-pluggable module board to be flush with the electrical connections 210 even when the head portion of the mounting screws extend below the hot-pluggable module board.

In some examples, the socket connector 204 can be a single socket connector unit. That is, in some examples, the socket connector 204 can be a single piece. In some examples, the socket connector 204 can be a plurality of pieces that can be coupled together when a module board is coupled to the socket connector 204. In some examples, each of the plurality of pieces can be individually coupled to a system board. For example, the plurality of pieces can include a first piece comprising the electrical contacts and a second piece comprising the recessed connection apertures (e.g., recessed portion 206 and aperture portion 208).

The socket connector 204 can be utilized to couple a number of different types of module boards to a system board. For example, the socket connector 204 can be utilized to receive hot-pluggable module boards and embedded module boards. Utilizing the same socket connector 204 for a number of different types of module boards can provide versatility and upgradability for a computing device utilizing the system board. In some examples, the module board may have a relatively larger area than the socket connector 204.

Figure 3:
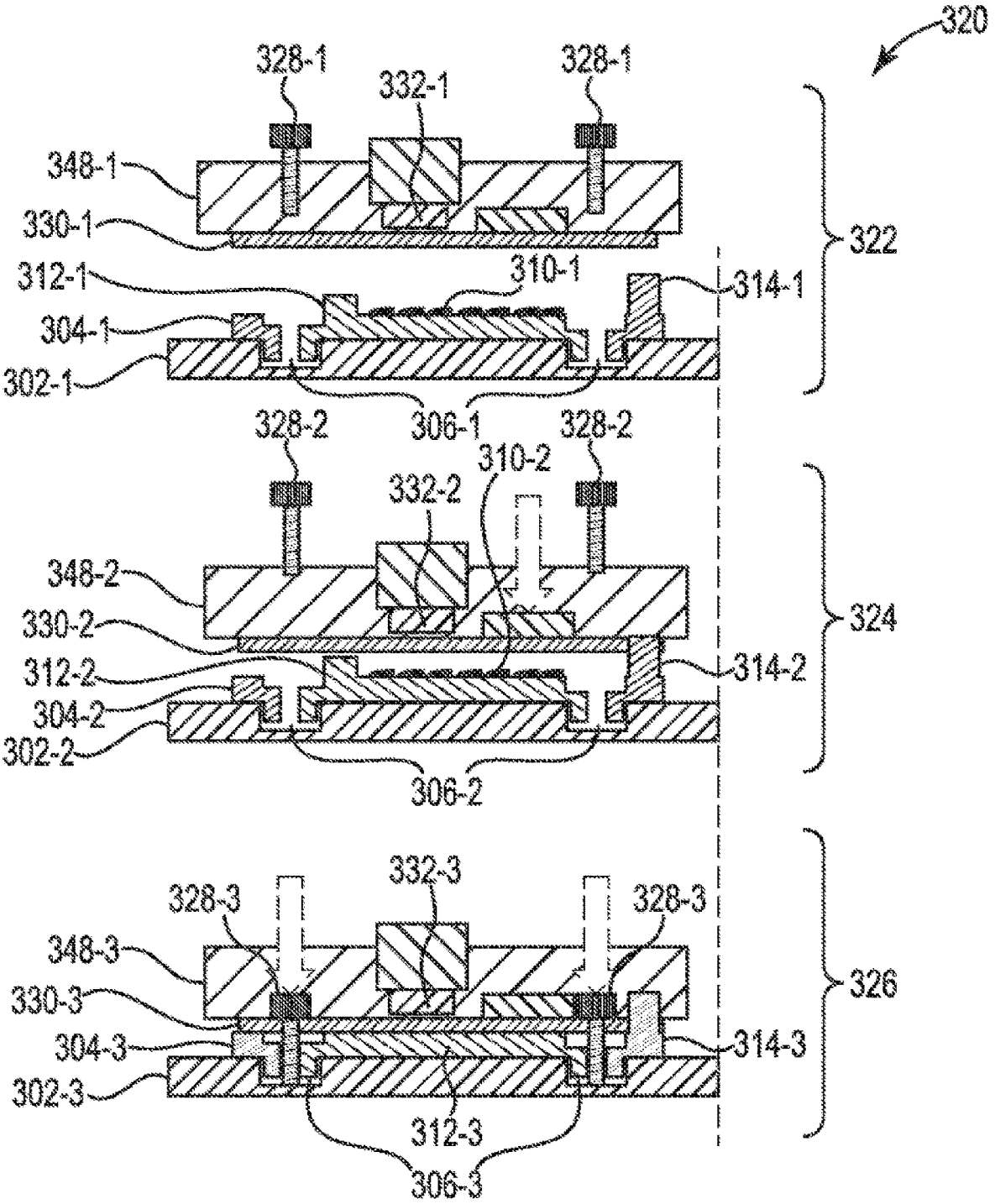
FIG. 3 illustrates a diagram of an example of a system for a socket connector consistent with the present disclosure.

FIG. 3 illustrates a diagram of an example of a system 320 for a socket connector consistent with the present disclosure. In some examples, the system 320 can be utilized to mount an embedded module board 330 to a socket connector 304 that is coupled to a system board 302. As described herein, the socket connector 304 can be utilized to couple an embedded module board 330 or a hot-pluggable module board (not shown).

At 322, the system 320 can include a module carrier 348-1 coupled to the embedded module board 330-1. In some examples, the embedded module board 330-1 can be coupled to an optical transceiver 332-1. In some examples, the optical transceiver can include an optical transmission module and an optical receiver module. In some examples, the module carrier 348-1 and embedded module board 330-1 can be vertically above a socket connector 304-1 that is coupled to a system board 302-1. As described herein, the socket connector 304-1 can include a number of electrical connections 310-1 and a number of recessed connection apertures that include an aperture portion 306-1. As described herein, the socket connector 304-1 can include a number of alignment features 312-1, 314-2. In some examples, the socket connector 304-1 can include a horizontal alignment feature 314-1 and a vertical alignment feature 312-1 as described herein. In some examples, a number of mounting screws 328-1 can be utilized to couple the embedded module board 330-1 to the socket connector 304-1. There may be additional screws (not shown) to couple the module carrier 348-1 to the embedded module board 330-1.

At 324, the embedded module board 330-2 and module carrier 348-2 can be lowered towards the socket connector 304-2. In some examples, the horizontal alignment feature 314-2 can have a relatively greater size compared to the vertical alignment feature 312-2. In some examples, the horizontal alignment feature 314-2 can act as a vertical alignment feature when an embedded module board 330-2 is being coupled to the electrical connections 310-2 of the embedded module board 330-2. In some examples, the horizontal alignment feature 314-2 can interact with the embedded module board 330-2 before the vertical alignment feature 312-2. As described herein, the alignment features 312-2, 314-2 can align the embedded module board 330-2 with the electrical connections 310-2 and/or the number of recessed connection apertures comprising the aperture portion 306-2 with the number of mounting screws 328-2.

At 326, the embedded module board 330-3 and module carrier 348-3 can be coupled to the socket connector 304-3 and system board 302-3. In some examples, the number of mounting screws 328-3 can be coupled through the module carrier 348-3, module board 330-3, and the number of recessed connection aperture comprising the aperture portion 306-3 to fix the embedded module board 330-3 to the socket connector 304-3. In some examples, the number of alignment features 312-3, 314-3 can vertically align the embedded module board 330-3 to the electrical connections and the number of recessed connection apertures comprising the aperture portion 306-3.

The system 320 can be utilized to couple a number of different types of module boards to a system board 302. FIG. 3 illustrates the module boards 330 to be about the same size as the corresponding socket connectors 304. For example, a module board 330 may have a larger size than the socket connector 304 as long as the module board 330 has notches at the corresponding positions to align with the alignment features 312 and 314. In another example, the socket connector 304 can be utilized to receive hot-pluggable module boards (not shown) and embedded module boards 330. Utilizing the same socket connector 304 for a number of different types of module boards can provide versatility and upgradability for a computing device utilizing the system board 302.

Figure 4:
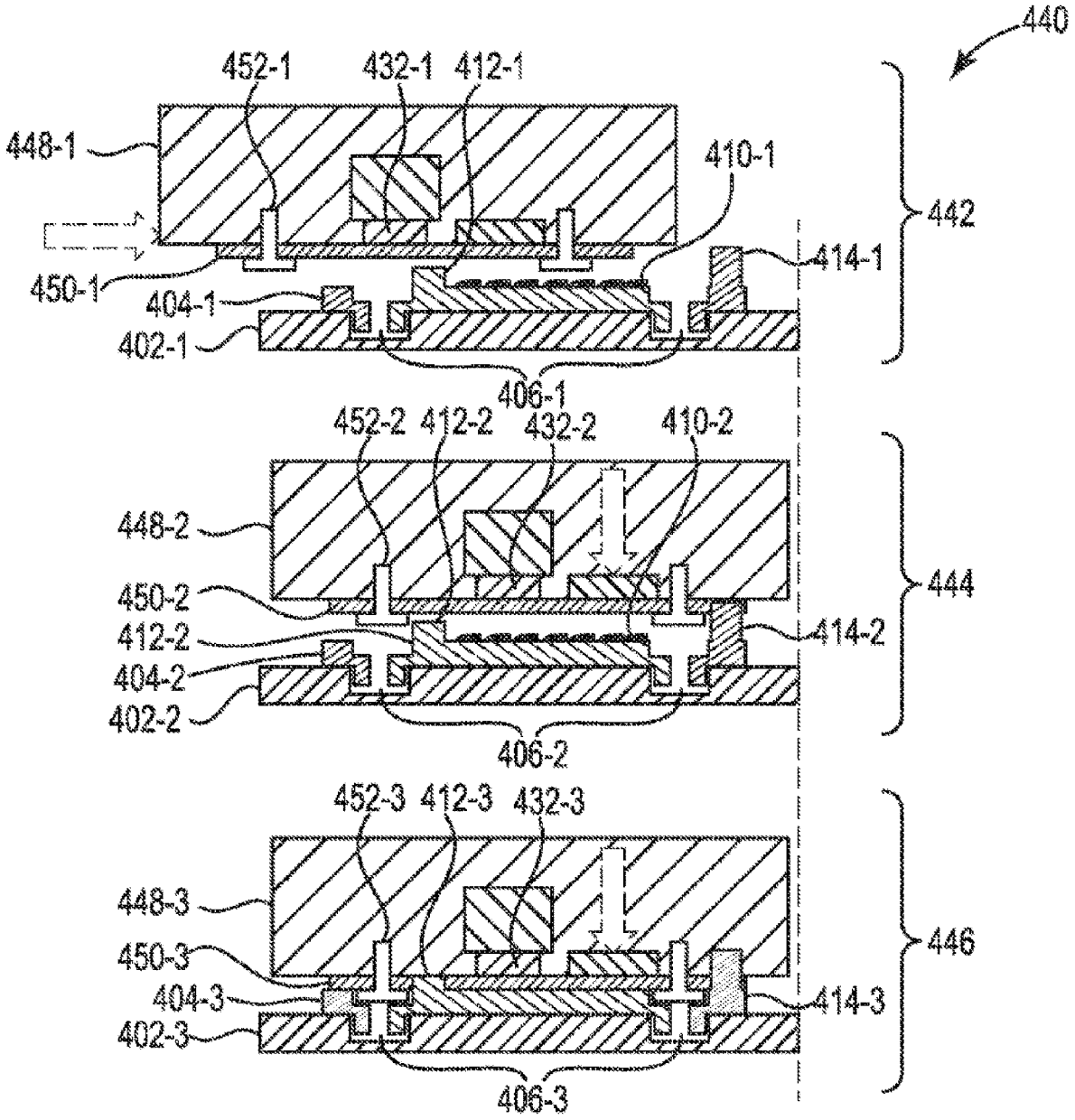
FIG. 4 illustrates a diagram of an example of a system for a module board mount consistent with the present disclosure.

FIG. 4 illustrates a diagram of an example of a system 440 for a socket connector consistent with the present disclosure. In some examples, the system 440 can be utilized to couple a hot-pluggable module board 450 to a system board 402. In some examples, the hot-pluggable module board 450 can be coupled to the system board 402 via horizontal insertion and vertical lowering when the hot-pluggable module board 450 is fully inserted.

At 442, the hot-pluggable module board 450 and module carrier 448-1 can be inserted horizontally to the system board 402-1 and/or socket connector 404-1. As described herein, the socket connector 404-1 can include a vertical alignment feature 412-1 that is short enough to allow the hot-pluggable module board 450 and module carrier 448-1 to pass over the vertical alignment feature 412-1. In some examples, the hot-pluggable module board 450-1 can include a number of notches that can be coupled to a horizontal alignment feature 414-1. In some examples, when the notches of the hot-pluggable module board 450-1 are coupled to the horizontal alignment feature 414-1 the hot-pluggable module board 450-1 can be horizontally aligned with the socket connector 404-1.

In some examples, the socket connector 404-1 can include a number of recessed connection apertures that include an aperture portion 406-1 as described herein. In some examples, a recessed portion of the number of recessed connection apertures can be utilized to receive a head portion of a number of mounting screws 452-1. For example, the head portion of the number of mounting screws 452-1 can extend below the hot-pluggable module board 450-1. In this example, the recessed portion of the number of recessed connection apertures can receive the head portion of the mounting screws 452-1 that extend below the hot-pluggable module board 450-1.

At 444, the hot-pluggable module board 450-2 and module carrier 448-2 can be fully inserted horizontally. At 444, a device of the module carrier 448-2 can be utilized to lower the module board 450-2 to the socket connector 404-2. At 444, the hot-pluggable module board 450-2 can be horizontally aligned by the horizontal alignment feature 414-2 coupling to a number of notches of the hot-pluggable module board 450-2.

At 446, the hot-pluggable module board 450-3 and module carrier 448-3 can be vertically lowered on to the socket connector 404-3 to couple the hot-pluggable module board 450-3 to the system board 402-3. In some examples, a head portion of the mounting screws 452-3 can be seated within the recessed portion of the recessed connection apertures. In some examples, the hot-pluggable module board 450-3 can be vertically aligned by a number of vertical alignment features 412-3. In some examples, the number of vertical alignment features 412-3 can receive a number of notches within the hot-pluggable module board 450-3.

The system 440 can be utilized to couple a number of different types of module boards to a system board 402. For example, the socket connector 404 can be utilized to receive hot-pluggable module boards 450 and embedded module boards (not shown). FIG. 4 illustrates the module boards 450 to be about the same size as the corresponding socket connectors 404. For example, a module board 450 may have a larger size than the socket connector 404 as long as the module board 450 has notches at the corresponding positions to align with the alignment features 412 and 414. Utilizing the same socket connector 404 for a number of different types of module boards can provide versatility and upgradability for a computing device utilizing the system board 402.

Figure 5:
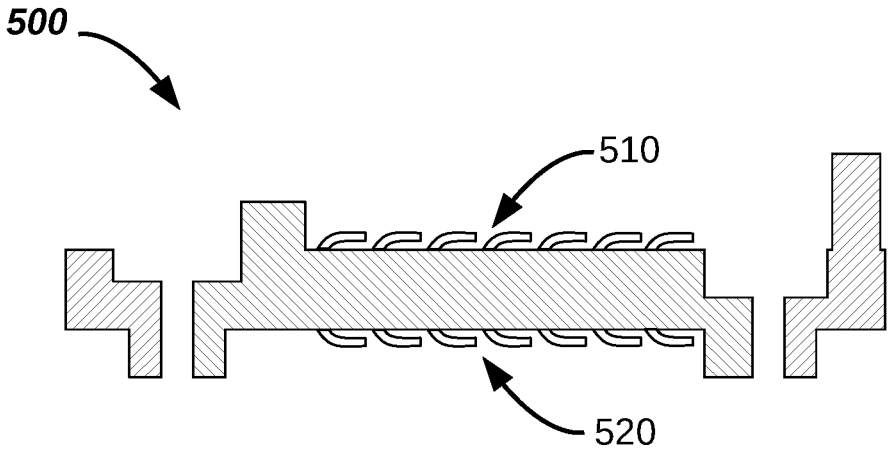
FIG. 5 illustrates a diagram of an example of a system for a socket connector consistent with the present disclosure.

Referring to FIG. 5, one embodiment of the present disclosure includes socket 500 comprising a first number of electrical connections 510 on a first side of the socket to couple to the module board and a second number of electrical connections 520 on a second side of the socket to couple to the system board.

As used herein, "logic" is an alternative or additional processing resource to perform a particular action and/or function, etc., described herein, which includes hardware, e.g., various forms of transistor logic, application specific integrated circuits (ASICs), etc., as opposed to computer executable instructions, e.g., software firmware, etc., stored in memory and executable by a processor. Further, as used herein, "a" or "a number of" something can refer to one or more such things. For example, "a number of widgets" can refer to one or more widgets.

The above specification, examples and data provide a description of the method and applications, and use of the system and method of the present disclosure. Since many examples can be made without departing from the spirit and scope of the system and method of the present disclosure, this specification merely sets forth some of the many possible example configurations and implementations.

What is claimed:

1. A system for a socket connector, comprising:

a first alignment feature with a first height to engage with a module board and to horizontally align the module board with a socket on the socket connector; and a second alignment feature with a second height to engage with the module board and to vertically align the module board with the socket;

wherein the first height is greater than the second height, wherein:

the module board is coupled to the socket connector by a number of recessed connection apertures and the module board is an embedded module board, and wherein the recessed connection apertures receive a screw head within the recessed portion of the recessed connection apertures from a number of mounting screws that couple the module board to a module carrier when the module board is a hot-pluggable module board.

2. The system of claim 1, wherein:

the second alignment feature allows the module board to horizontally pass over the second alignment feature; and the module board is a hot-pluggable module board.

3. The system of claim 2, wherein the second alignment feature vertically aligns the hot-pluggable module board when the hot-pluggable module board is vertically lowered on the socket.

4. The system of claim 1, wherein the recessed connection apertures receive mounting screws to physically couple the module board to the socket connector.

5. 1, wherein:

the first alignment feature and second alignment feature vertically align the module board and the module board is an embedded module board.

6. The system of claim 1, comprising:

a first number of electrical connections on a first side of the socket to couple to the module board; and a second number of electrical connections on a second side of the socket to couple to a system board.

7. A socket connector, comprising:

a number of electrical connections to couple a module board to a system board; and a number of recessed connection apertures to:

receive a number of mounting screws coupled through the module board when the module board is an embedded module board;

receive a screw head within the recessed portion of the recessed connection apertures from the number of mounting screws that couple the module board to a module carrier when the module board is a hot-pluggable module board.

8. The socket connector of claim 7, comprising a first alignment feature with a first height to engage with the module board, wherein the first alignment feature horizontally aligns the module board with the number of electrical connections.

9. The socket connector of claim 8, comprising a second alignment feature with a second height to engage with the module board, wherein the second alignment feature vertically aligns the module board with the number of electrical connections.

10. The socket connector of claim 8, wherein the first alignment feature vertically aligns the module board when the module board is an embedded module board.

11. The socket connector of claim 7, wherein the second alignment feature allows the module board to horizontally pass over the second alignment feature when the module board is a hot-pluggable module board.

12. The socket connector of claim 9, wherein the first height is greater than the second height.

* * * * *